US005622151A

United States Patent [19]

Lang

[11] Patent Number: 5,622,151

[45] Date of Patent: Apr. 22, 1997

[54] METHOD AND ARRANGEMENT FOR CONTROLLING AN ADJUSTING DEVICE FOR AN INTERNAL COMBUSTION ENGINE IN A MOTOR VEHICLE

[75] Inventor: Eberhard Lang, Erligheim, Germany

[73] Assignee: Robert Bosch GmbH, Stuttgart, Germany

[21] Appl. No.: 345,828

[22] Filed: Nov. 21, 1994

[30] Foreign Application Priority Data

Dec. 4, 1993 [DE] Germany ..... 43 41 391.9

[51] Int. Cl.[6] ..... F02D 41/00

[52] U.S. Cl. ..... 123/339.15; 73/118.1; 123/339.14; 123/399

[58] Field of Search ..... 123/339.15, 339.25, 123/339.26, 339.27, 399, 479, 359, 339.14; 73/118.1

[56] References Cited

U.S. PATENT DOCUMENTS 5,159,831 11/1992 Kitagawa et al. ..... 123/399 X
5,204,816 4/1993 Wright et al. ..... 123/479 X
5,320,076 6/1994 Reppich et al. ..... 123/399
5,339,782 8/1994 Golzer et al. ..... 123/399
5,501,193 3/1996 Schneider et al. ..... 123/339.14

FOREIGN PATENT DOCUMENTS 4126365 2/1993 Germany .

*Primary Examiner*—Tony M. Argenbright
*Attorney, Agent, or Firm*—Walter Ottesen

[57] ABSTRACT

A method and an arrangement for the control of an adjusting device for an internal combustion engine is proposed in which the operative connection between an adjusting device and an output element is detected based on a predetermined and adaptable association of at least two pieces of position data. In this method and arrangement, the operative connection and/or faults with respect to the at least two pieces of position data can be detected.

11 Claims, 3 Drawing Sheets

METHOD AND ARRANGEMENT FOR CONTROLLING AN ADJUSTING DEVICE FOR AN INTERNAL COMBUSTION ENGINE IN A MOTOR VEHICLE

BACKGROUND OF THE INVENTION

German patent publication 4,126,365 discloses a method and an arrangement for controlling an adjusting device. In this method and arrangement, two pieces of position data (position signal values) with reference to the position of the adjusting device or of the output element actuated thereby are provided. To detect the idle command, a fixed pregiven characteristic line ratio of the two pieces of position data is determined at the end of the production or when the vehicle is first driven. The characteristic line ratio is determined during operation by evaluating the slope differences and offsets of the characteristic lines and is compared to the fixed pregiven characteristic line ratio for detecting the idle command.

Measures for determining the relationship given between the above-mentioned at least two pieces of position data without at least knowing one position of the adjusting device are not described. Likewise, no measures are provided to adapt this relationship to changes. Also, applications of the determined relationship are not described which go beyond idle detection for a specific arrangement.

SUMMARY OF THE INVENTION

It is an object of the invention to provide measures for determining the relationship given between at least two pieces of position data with respect to the position of an adjusting device when the exact position of the adjusting device is not known. It is a further object of the invention to provide such measures also while taking into account changes or possibilities for evaluating the determined relationship.

The German patent publication 4,126,365 referred to above discloses a special adjusting device which actuates an output element via an electrical path in at least one operating state, especially for idle control. The output element is especially a power-output element such as a throttle flap. Outside of this at least one operating state, the output element is actuated independently of the adjusting device in another manner such as via a mechanical connection which can be effected by the driver by actuating an accelerator pedal. Here it is essential to detect when the output element can be actuated by means of the adjusting device especially for carrying out the functions available for idle control. Stated otherwise, it must be detected whether the output element is operatively connected to the adjusting device or whether the output element is actuated by the driver independently of the adjusting device.

In addition to the application of the determined relationship between the position data for detecting idle in an arrangement of this kind, the association can be used also for detecting a fault in adjusting devices which are operatively connected to the output element over the entire positioning range and which make available the two pieces of positioning data.

With the method and arrangement of the invention, a given relationship can be determined between at least two pieces of position data with respect to the position of an adjusting device even when the exact position of the adjusting device is not known. Furthermore, this relationship is adapted to changes at each pregiven time point.

The determined relationship is processed in such a manner that the relationship can be evaluated for different purposes independently of the type of adjusting device.

The method and arrangement of the invention make available a simple and precise detection as to whether the positioning device and output element are operatively connected to each other and/or whether faults are present in the area of the position data.

By determining the synchronism of the two pieces of position data, the data necessary for detecting the operative connection and/or for monitoring faults is determined in a simple and precise manner.

Furthermore, reliable fault detection is achieved from the comparison of the synchronism of the two pieces of position data.

The pregiven relationship can be determined or adapted in every operating state with the measures according to the invention. For example, this determination and adaptation can be made for every and/or selected vehicle starts, for original starts (first start after disconnecting the battery or interrupting the current supply), after each exchange of a component, during driving operation, et cetera.

Operating states (in which the operative connection between the adjusting device and the output element is probable, for example, overrun operation, idle operation or in the holding phase) are used to determine the operative connection between adjusting device and output element.

In this way, the determination of the relationship of the position data at the end of motor vehicle production can be omitted in an advantageous manner. No special equipment is required for this determination so that production is economical.

It is especially advantageous that data as to the idle command of the driver is obtained without the need of mechanical components. Furthermore, it is advantageous that the output element stops must not be driven against. Accordingly, an output element which is resistant to stops is unnecessary and this leads to a solution which is considerably lower in cost.

In this context, it is also advantageous that the position transducer connected to the adjusting device is a potentiometer or a pulse transducer which operates pursuant to the Hall principle and has a counter connected thereto.

Furthermore, the method and arrangement of the invention (for detecting the relationship and/or for detecting faults) can be applied in an advantageous manner when a mechanical idle contact is defective after an original start or when data as to the relationship of the position data is not available.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
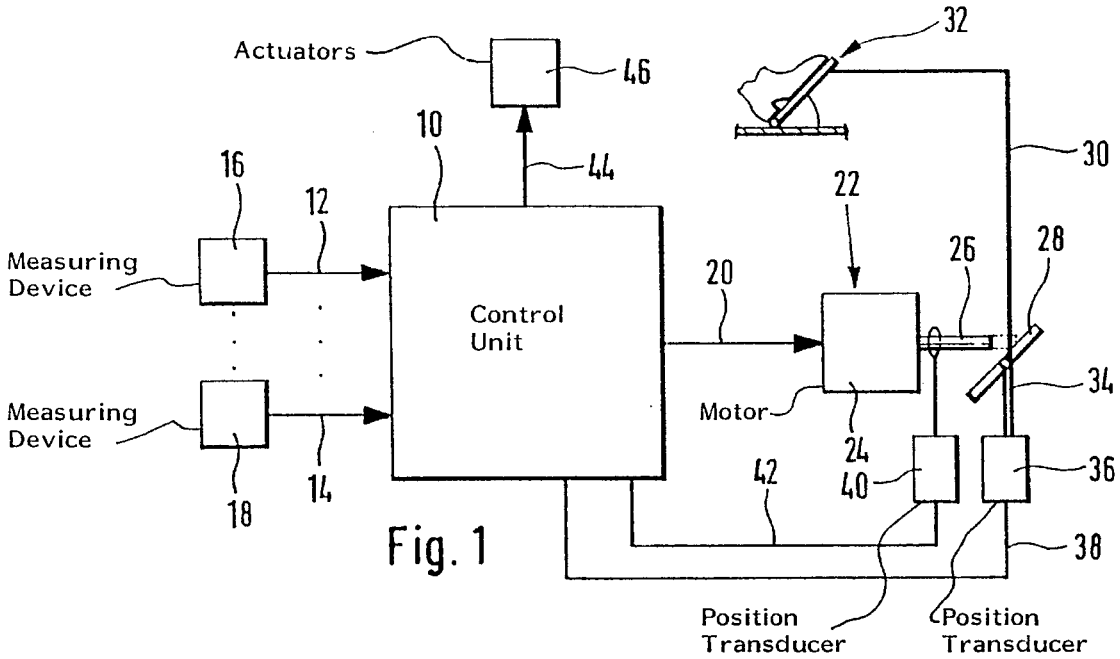
FIG. 1 is an overview block circuit diagram of a control arrangement for an adjusting device for an internal combustion engine of a motor vehicle.

FIG. 1 shows a preferred embodiment with an adjusting device which is only operatively connected to the power output element when the accelerator pedal is released. Reference numeral 10 identifies a control unit to which measuring devices 16 to 18 are connected via input lines 12 to 14, respectively. An output line 20 connects the control unit 10 to an adjusting device 22 which, in a preferred embodiment, comprises a motor 24 and a movable stop 26. In addition, an output element 28 is provided which, in the preferred embodiment, is a throttle flap mounted in an air intake system (not shown) of an internal combustion engine (also not shown).

The output element 28 is connected via a mechanical connection 30 to an operator-actuated element 32 which is preferably an accelerator pedal. Furthermore, a mechanical or electrical connection 34 connects output element 28 to a first position transducer 36 having an output line 38 connected to the control unit 10. The position of the adjusting device 22 is determined by a second position transducer 40 having an output line 42 which is likewise connected to the control unit 10. In addition, further output lines 44 are provided which lead to actuators 46 for influencing other operating variables of the internal combustion engine such as fuel metering and/or ignition time point adjustment.

The operator controls the output element 28 via the mechanical connection 30 by actuating the accelerator pedal 32 and thereby adjusts the power of the engine. The position of the output element 28 and therefore the position of the accelerator pedal 32 is detected by position transducer 36 which, in a preferred embodiment, is a potentiometer. The position transducer 36 then outputs a corresponding measurement value $U_{p1}$ via the line 38 to the control unit 10. Operating variables of the engine and/or of the motor vehicle are supplied to the control unit 10 via lines 12 to 14. These operating variables can, for example, be engine temperature, engine rpm, battery voltage, air throughput, status of ancillary consumers, et cetera.

In addition, the control unit 10 determines the quantity of fuel to be injected and/or the ignition angle to be adjusted in a known manner based upon engine rpm and air throughput and, if required, with a correction dependent upon exhaust gas composition, engine temperature, et cetera. Corresponding signals are outputted by the control unit 10 via the line 44 to actuators such as the injection valve and/or ignition distributor. In the case of idle, when the driver has completely or almost completely released the accelerator pedal 32, the output element 28 is in contact engagement with the movable stop 26 of the adjusting device 22; that is, adjusting device 22 and output element 28 are operatively connected to each other.

The above-mentioned operating variables are supplied to the control unit 10 for controlling the idle adjustment of the output element 28, especially for controlling the idle rpm of the internal combustion engine. The control unit 10 does the following: forms a desired set value for the engine rpm on the basis of engine temperature, the status of ancillary consumers, et cetera; places the desired set value into relationship with the actual value of the engine rpm; and, converts the difference between the two values into a desired value (position desired value, air throughput desired value or voltage desired value) in accordance with a pregiven control strategy (for example, PID). This desired value, which is converted from the difference, is for the output element 28 or the stop 26. This desired value, in turn, is set into relationship with the position data as to the position of the output element 28 and, in dependence upon the difference, a control unit forms a drive signal for the adjusting device 22 in accordance with a pregiven control strategy (for example, PID). The position data is supplied via line 38 and the drive signal is outputted via the output line 20.

In summary, it can be stated that the control unit 10 actuates the adjusting device 22 (that is, its movable stop 26 or the output element 28 in the case of idle when the accelerator pedal 32 is released) in the sense of an approximation of the position to the desired value and in the sense of an approximation of the engine rpm to its desired value. What is decisive is that the idle command of the driver for the activation of the idle rpm control is detected. Stated otherwise, it must be detected that the output element 28 is in contact engagement with the stop 26. This takes place via the position transducer 40, which outputs a measure for the position of the stop 26 to the control unit 10 via the line 42, and via the position transducer 36. In the preferred embodiment, the position transducer 40 is likewise a potentiometer which outputs a measurement signal for the adjusting range of the adjusting device (idle range of the output element 28).

The use of a position transducer operating in accordance with the Hall principle can be advantageous in other embodiments. The position transducer outputs pulse signals via the line 42 to the control unit 10. The control unit 10 evaluates the pulse signals by counting up and counting down and forms a piece of position data in this manner. Furthermore, and in some embodiments, a mechanical switching element can be provided which changes its switching state when the output element 28 comes into contact engagement with the stop 26.

Figure 2A:
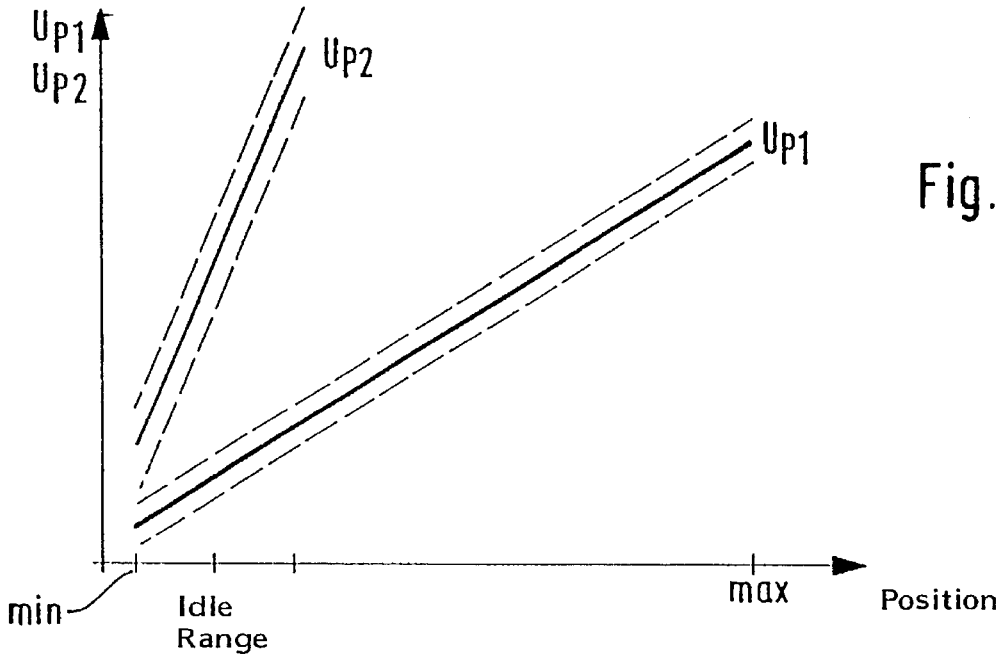
FIGS. 2*a* and 2*b* are graphs showing the characteristic line traces of transducers utilized to detect the position data of an adjusting device and an output element.
Figure 2B:
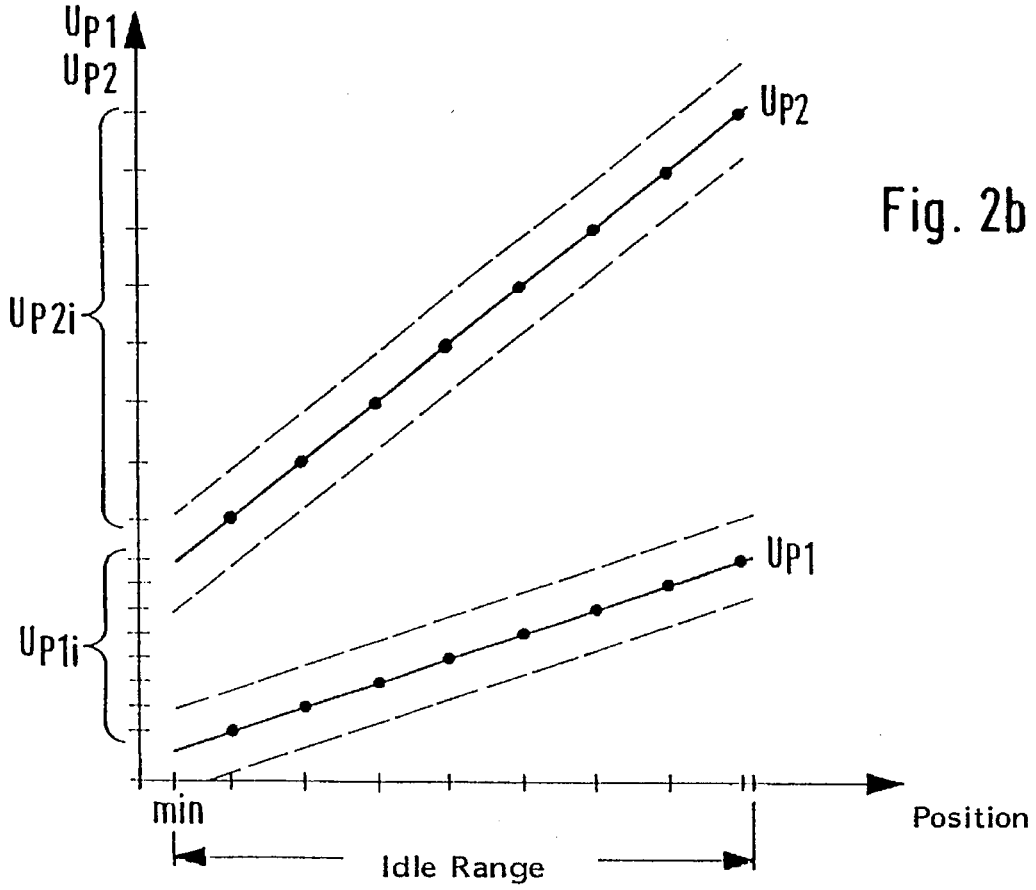

In FIGS. 2*a* and 2*b*, typical characteristic traces of the position transducers 36 and 40 are shown. The values $U_{p1}$ and $U_{p2}$ are assigned to position transducers 36 and 40, respectively. In FIGS. 2*a* and 2*b*, the position of the output element is plotted from the minimum value to the maximum value on the horizontal axis; whereas, the signal values $U_{p1}$ and $U_{p2}$ are plotted on the vertical axis. To show the procedure provided by the invention, FIG. 2*b* shows a detail of the relationship shown in FIG. 2*a* for the idle range, which lies in the range between 0° and 30° for the position of the output element for the preferred embodiment. In other embodiments, this range can extend to a value less than 30°.

According to FIG. 2*a*, the characteristic line of the position transducer 36 shows an essentially linear trace over the entire range of the output element position or accelerator pedal position; whereas, the characteristic line of the position transducer 40 shows an essentially linear trace only in the adjusting range of the adjusting device (in the idle adjusting range of the output element). The linear characteristic lines shown are exemplary. In reality, the characteristic lines fluctuate within the positioning range as well as from one transducer sample to another transducer sample. The tolerance limits, shown by broken lines in FIG. 2*a*, show this behavior. In FIG. 2*a*, one sample of the position transducers 36 and 40 is selected.

The characteristic lines fluctuate in the tolerance ranges shown or can change within these ranges. For this reason, the relationship between the two characteristic lines must be detected and adapted to recognize the idle command (that is, the contact engagement of the output element on the stop of the adjusting device). This is achieved in accordance with the measures of the invention which are outlined in the flowchart of FIG. 3.

The basic realization of this procedure is that the pieces of position data must change in synchronism with each other (that is, in pregiven directions and possibly supplementary in pregiven absolute value limits) when the output element is in contact and when the adjusting device is actuated. If this is the case, then the arrangement is in the desired idle state and the relationship or the association between the characteristic lines can be detected. If no synchronism is present between the pieces of position data, then either a fault condition is present or the output element does not lie against the adjusting device, that is, the driver accelerates.

Figure 3:
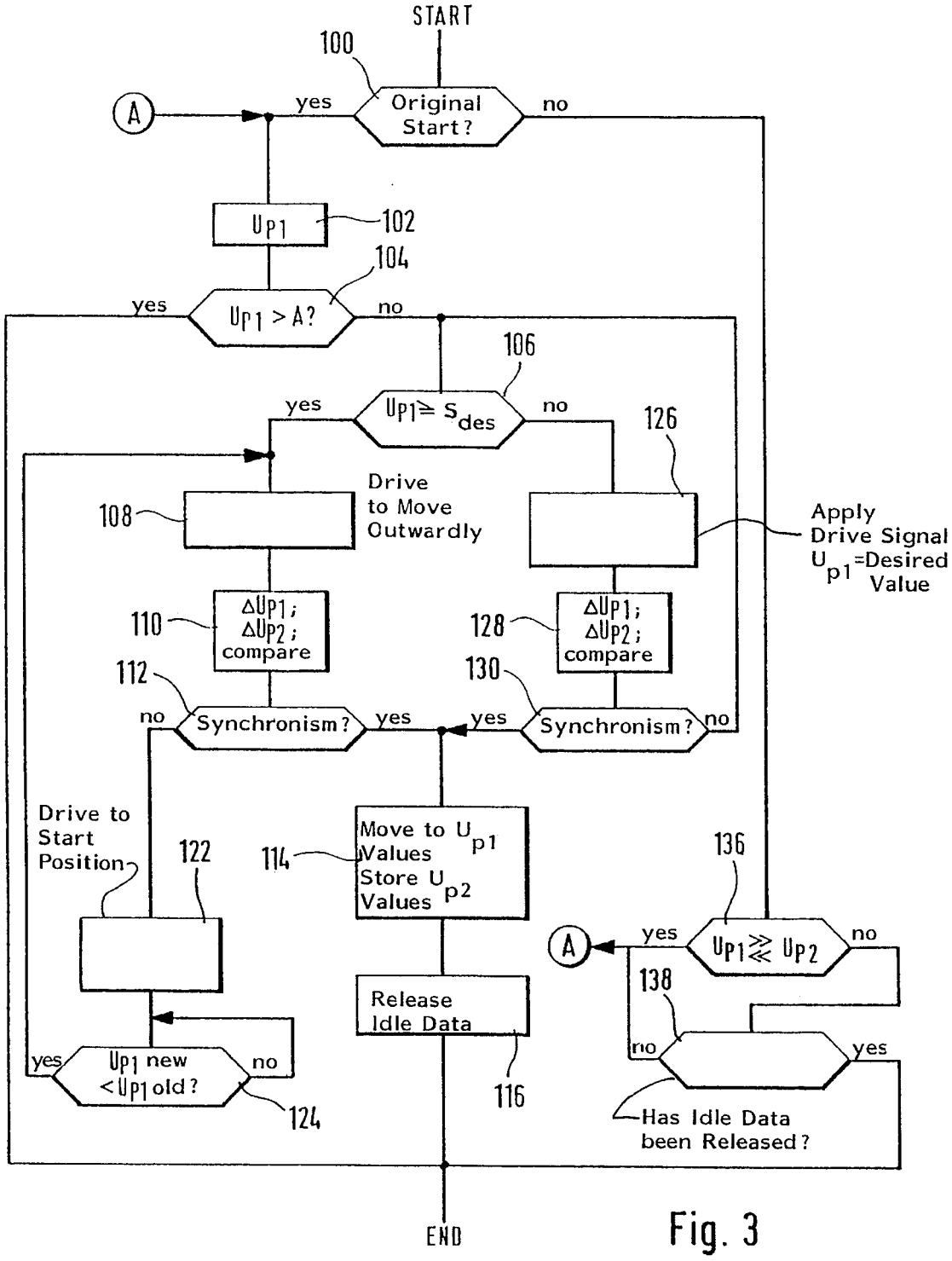
FIG. 3 is a flowchart depicting a program with which the relationship between the position data, which is necessary for detecting the operative connection between adjusting device and output element, is determined; and, FIG. 4 shows a flowchart for applying the derived stored association for fault monitoring.

The procedure shown in FIG. 3 can be executed under the following conditions: for each start of the motor vehicle, for selected starts or for so-called original starts (the first start after disconnecting and reconnecting the battery or interrupting the current supply), after changing a component or in operating states wherein the established operative connection is probable (for example, idle state, overrun operation, holding phase) whereby a detection is made as to whether the driver accelerates.

After the start of the subprogram at pregiven times, a check is made in the first inquiry step 100 as to whether, for example, such an original start (or another selected condition) is present. This takes place, for example, with respect to a mark which is set when the memory content of the control unit 10 is erased because of an interruption of the current supply. If such an original start is present, then the position data (voltage values, counter positions) $U_{p1}$ and $U_{p2}$ of position transducers 36 and 40, respectively, are read in in step 102 and, in the next inquiry step 104, a check is made as to whether the output element is in a position outside of the range of movement of the adjusting device; that is, whether the position value $U_{p1}$ is greater than a position range limit value A. If this is not the case, then, in the next inquiry step 106, a check is made as to whether the measured value $U_{p1}$ is greater or equal to the desired value S for the setting of the adjusting device. If the output element is above the desired position value, then, and in accordance with step 108, the adjusting device is driven for a pregiven angle range in tile sense of increasing the position signal $U_{p1}$, that is, in the sense of opening the output element. This can also be a drive for a pregiven time duration.

Thereafter, in step 110, the change of the signal values $U_{p1}$ and $U_{p2}$, which has occurred because of delving, is detected and (if the position transducers 36 and 40 are potentiometers or other, preferably contactless absolute position transducers) compared to each other as to sign and, advantageously also as to magnitude. The change of the signal values is determined by difference formation at the start and at the end of the drive operation in accordance with step 108; whereas, the comparison of the two differences is undertaken to determine whether the signal values change in the pregiven direction; that is, in the example of FIGS. 2*a* and 2*b*, if the two signal values change to larger values when the drive signal is initiated.

In the next inquiry step 112, a check is made as to whether such a synchronism is present. If this is the case, then specific $U_{p1}$ values are driven toward and the $U_{p2}$ values which result are stored in a coordinating characteristic line (step 114). An association of the $U_{p1}$ values to the $U_{p2}$ values results and therefore a relationship between the position data which can be evaluated in an advantageous manner. Thereafter, and in accordance with step 116, the idle detection data (or the fault check data) is released and the subprogram ended.

In addition to the determination of the synchronism in the steps 110 and 112, the absolute values of the differences are checked with respect to predetermined tolerance values in a preferred embodiment. In this way, a check is made as to whether a pregiven change of the $U_{p1}$ value results in a change of the value $U_{p2}$ lying within pregiven tolerances. If this is the case, then the arrangement operates correctly; however, if the change of the $U_{p2}$ value lies outside of the tolerance range then it can be assumed that a fault (for example, a characteristic line shift of the position transducer) is present and a corresponding fault is stored. This is not shown in FIG. 3 for reasons of clarity and is to be inserted as an inquiry step forward or after step 112 (for a "yes" as well as for a "no" decision).

If in step 112 no synchronism results, then it can be assumed that the adjusting device and the output element are not operatively connected to each other and the adjusting device is, according to step 112, again moved back to the output position $U_{p1}$. In such a situation, the driver probably has accelerated during the start operation and a renewed check of the idle detection can only take place when a position value $U_{p1}$ is measured for the output element which is less than the value which formed the basis of the preceding check (step 124). If this is the case, then the subprogram is repeated starting with step 108.

If it had been detected in step 106 that the actual position value $U_{p1}$ of the output element is less than the desired value (position desired value, air throughput desired value or voltage desired value) of the idle control, then, according to step 126, the adjusting device is driven until the value $U_{p1}$ is equal to the desired value. Thereafter, in step 128, and in the same manner as in step 110, the changes (caused by application of the drive signal) of the measured values $U_{p1}$ and $U_{p2}$ are detected and compared to each other. In step 130 and in the same manner as in step 112, a check is made as to whether synchronism is present. If this is the case, then the program continues with steps 114 and 116; whereas, if synchronism is not present, it can be assumed that an actuation of the accelerator pedal has been carried out in the meantime and the subprogram is repeated starting with step 106.

If it had resulted in step 104 that the output element position lies outside of the position range of the adjusting device, the subprogram is immediately ended because the boundary conditions for determining the relationship of tile position data for idle detection are not present.

If, in step 100, it had been determined that no original start conditions are present, then, for a normal start of the engine, an inquiry is made in inquiry step 136 as to whether the detected value $U_{p1}$ is significantly greater or significantly less than the value $U_{p2}$, that is, whether the driver starts by applying the accelerator pedal or whether a repair or other change had taken place. If this is the case, then original start conditions are assumed and the subprogram is carried out with step 102. If this is not the case, then a check is made in accordance with step 138 as to whether the idle data (or fault check data) is released, that is, whether at least one successful comparison in accordance with FIG. 3 has taken place. If this is not the case, an original start is assumed; whereas, when idle data has been released, the subprogram is ended and normal operation is initiated.

The procedure of FIG. 3 for a detected synchronism of the position value movement is shown in FIG. 2*b*. The procedure shown in FIG. 3 leads to the situation that for different values $U_{p1}$ (shown as $U_{p1i}$ in FIG. 2*b*) values of $U_{p2}$ can be associated ($U_{p2i}$) which are stored in pairs in an association table. Preferably, eight support points $U_{p1}$ are approached and value pairs are formed. The result of the procedure of FIG. 3 is therefore an association table of $U_{p1}$ values to $U_{p2}$ values which describes the real characteristic line ratios in the support locations and defines a connection of the two characteristic lines to each other at the support points. The table can at any time be made anew or adapted without the necessity of complex equipment and complex adjusting measures for the vehicle production. If intermediate values are detected in normal operation, then these are defined by linear interpolation between the two support points.

In this way, the procedure of the invention for detecting the idle command works without determining slope differences and offsets. The precision is guaranteed at all times by the plurality of support points, The described procedure is to be applied in the same way when a Hall sensor instead of a potentiometer is used as the position transducer for the position of the adjusting device. The pulse signal of the Hall sensor is counted by the control unit to thereby determine position data. The counter is then reset to a reference value such as zero when synchronism of the position data $U_{p1}$ and the change of the counter state is detected. Starting from this reference value, the procedure explained above is followed wherein the counter state is to be understood as position data $U_{p2}$.

In addition to the preferred embodiment shown in FIGS. 2*a* and 2*b* of the position transducers having characteristic lines running in the same direction, the procedure of the invention can be applied in other advantageous embodiments also in combination with oppositely running characteristic lines.

The procedure of the invention is not only advantageously applicable in connection with idle actuators, but everywhere where the operative connection between an adjusting device and an output element is to be determined on the basis of at least two pieces of position data.

The adjusting device-output element arrangement can also include a mechanical idle switch which outputs a switching signal when the output element contacts the adjusting device. In this case, the procedure of the invention is then advantageously utilized when (with corresponding fault monitoring strategies known per se) it has been determined that the switch is defective and the data as to the relationship of the position data is not present. This can, for example, be the case when the idle switch no longer closes or no longer opens after an exchange of the adjusting device or of the output element and, because of the exchange, no stored relationship between the two pieces of data is present. Furthermore, the determined association table for such an arrangement can be evaluated for fault detection as described below when the idle switch is in good order or defective.

Figure 4:
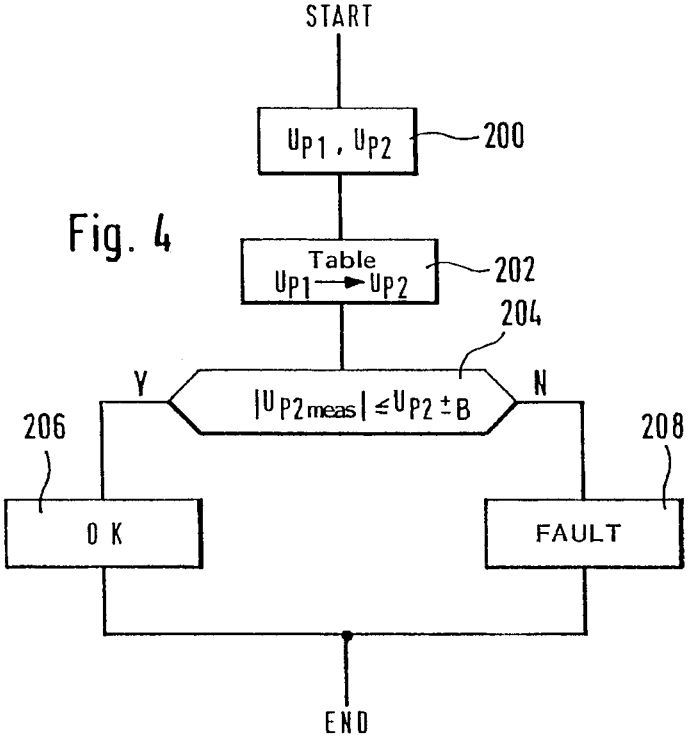

In addition to the application of the determined association described above, this association can be used for monitoring the position data for faults in an advantageous embodiment according to FIG. 4. The two pieces of position data $U_{p1}$ and $U_{p2}$ are read in in step 200. Then, the particular value of the first piece of position data present is detected by interpolation between the two next adjacent support points of the determined association. Then, likewise by interpolation between two next adjacent support points, the value of the second piece of position data assigned to this value is determined (step 202). The value of the second piece of position data actually detected and computed by interpolation between the two next adjacent support points is then checked utilizing the determined association value with respect to a pregiven tolerance range B (step 204). If the amount of the difference between the values is less than the pregiven tolerance value B, then it is assumed that the pieces of position data are correct (step 206); whereas, in the other case, a fault must be assumed (step 208) when the amount of the difference is greater than the value B.

The procedure of FIG. 4 for monitoring faults can be applied in an advantageous manner also to systems wherein adjusting device and output element are continuously operatively connected to each other. This is the case, for example, with the so-called E-gas systems wherein the throttle flap is adjusted by an adjusting device via an electrical path in dependence upon driver command. The idle control is also carried out by this adjusting device in idle.

The determination of the association or of the relationship between the two pieces of position data takes place in this case not in accordance with FIG. 3; instead, this takes place either before a first drive with the car is started or at the end of vehicle production by approaching pregiven points of the first associated values and detection of the associated values of the second piece of position data or, during driving operation, when the pregiven points are approached by the control function.

It is understood that the foregoing description is that of the preferred embodiments of the invention and that various changes and modifications may be made thereto without departing from the spirit and scope of the invention as defined in the appended claims.

What is claimed is:

1. A method for controlling an electrically actuable adjusting device for an internal combustion engine in motor vehicles, the method comprising the steps of:

operatively connecting said adjusting device to an output element for influencing engine power in at least one operating state and causing said adjusting device to adjust said output element;

generating a first piece of position data with respect to the position of the output element and a second piece of position data with respect to the position of the adjusting device;

determining stored values in at least one operating state which establish a mutually synchronous change of said first and second pieces of position data from pregiven movement sequences; and, determining if the adjusting device is operatively connected to said output element based on said stored values.

2. The method of claim 1, wherein the stored values for detecting the operative connection between said adjusting device and said output element form a relationship of said first piece of position data to said second piece of position data in more than two points of the movement range of said adjusting device.

3. The method of claim 1, wherein said stored values are determined and stored in at least one operating phase as follows: before driving is commenced; in the start phase of the internal combustion engine, for an original start of disconnecting and reconnecting the battery or after an interruption in the current supply; after exchanging a component; or, in an operating state wherein an operative connection is probable.

4. The method of claim 1, wherein the adjusting device is driven when said output element has a position greater than the desired setting of said output element; the synchronous change of the pieces of position data is determined from a comparison of the change of the pieces of position data with respect to sign and with respect to the absolute values; and, the stored association values are determined when synchronism is detected.

5. The method of claim 1, wherein said adjusting device is driven to obtain a setting of the desired set value when the output element has positions less than the desired set value; and, synchronism is determined based on sign and on absolute value.

6. The method of claim 5, wherein storage of values is inhibited when synchronism is not determined.

7. The method of claim 1, wherein at least one of the following is detected: the operative connection between adjusting device and output element and a fault condition in at least one of the pieces of position data from the stored association of the first and second pieces of position data; and, wherein the association contains more than two value pairs; and, the operative connection is then assumed as being present when at least one of the following conditions is present: the pieces of position data lie within a pregiven tolerance range; and, a fault is assumed when the pieces of position data lie outside this range.

8. The method of claim 1, wherein a switching element is provided which changes its switching state when the operative connection between the adjusting device and the output element takes place; and, when there is a defect of said switching element, determining whether the operative connection is present.

9. A method for controlling an adjusting device for internal combustion engines in motor vehicles, the method comprising the steps of:

operatively connecting said adjusting device to an output element for influencing engine power and causing said adjusting device to adjust said output element;

generating at least two pieces of position data as to position of the output element and the adjusting device, respectively;

determining an association of said two pieces of position data with respect to each other and storing said association; and, determining a fault condition on the basis of the stored association in the region of one of said pieces of position data when one of said pieces of position data deviates impermissibly from its association.

10. An arrangement for controlling an adjusting device for an internal combustion engine in a vehicle, the arrangement comprising:

an electrically actuable adjusting device;

an output element for influencing the power of said engine;

means for providing a first piece of position data with respect to the position of said adjusting device;

means for providing a second piece of position data with respect to the position of said output element;

means for detecting the operative connection between said adjusting device and said output element on the basis of said first and second pieces of position data; and, means for determining the mutually synchronous change of said first and second pieces of position data from pregiven movement sequences for determining, in at least one operating state, stored values with respect to which said operative connection is determined.

11. An arrangement for controlling an adjusting device for an internal combustion engine in motor vehicles, the arrangement comprising:

an electrically actuable adjusting device having an output element for influencing the power of said engine;

means for providing at least two pieces of position data as to the position of said output element and said adjusting device, respectively;

means for determining and storing an association of said first and second position data with respect to each other; and, means for determining a fault condition in the region of one of said pieces of position data on the basis of the stored association when one of said pieces of position data deviates impermissibly from its association.

* * * * *

UNITED STATES PATENT AND TRADEMARK OFFICE

CERTIFICATE OF CORRECTION

PATENT NO. : 5,622,151
DATED : April 22, 1997
INVENTOR(S) : Eberhard Lang

It is certified that error appears in the above-indentified patent and that said Letters Patent is hereby corrected as shown below:

In column 5, line 44: delete "tile" and substitute -- the -- therefor.

In column 5, line 48: delete "delving" and substitute -- driving -- therefor.

Signed and Sealed this

Fourteenth Day of July, 1998

Bruce Lehman

*Attest:*

BRUCE LEHMAN

*Attesting Officer*

*Commissioner of Patents and Trademarks*